US009660322B1

(12) United States Patent
Liu

(10) Patent No.: US 9,660,322 B1
(45) Date of Patent: May 23, 2017

(54) USING A COARSE POSITIONING MECHANISM FOR PRECISION POINTING APPLICATIONS

(71) Applicant: The Boeing Company, Chicago, IL (US)

(72) Inventor: Yong Liu, San Marino, CA (US)

(73) Assignee: THE BOEING COMPANY, Chicago, IL (US)

( * ) Notice: Subject to any disclaimer, the term of this patent is extended or adjusted under 35 U.S.C. 154(b) by 601 days.

(21) Appl. No.: 14/182,860

(22) Filed: Feb. 18, 2014

(51) Int. Cl.
*H01Q 3/00* (2006.01)
*H01Q 1/12* (2006.01)

(52) U.S. Cl.
CPC ..... *H01Q 1/125* (2013.01)

(58) Field of Classification Search
CPC ..... H01Q 3/00; H01Q 1/125
USPC ..... 342/359
See application file for complete search history.

(56) References Cited

U.S. PATENT DOCUMENTS

2006/0065788 A1* 3/2006 Tsao ..... B64G 1/36 244/171

* cited by examiner

*Primary Examiner* — Harry Liu

(57) ABSTRACT

Apparatus, systems and methods provide for compensating for pointing errors that may occur when using a coarse positioning mechanism for pointing a payload toward a target. According to aspects of the disclosure, a coarse positioning mechanism is configured to compensate for pointing errors that may occur when pointing a payload toward a target over a large angular FOV. The coarse positioning mechanism may be configured for a variety of applications, such as precision tracking applications and precision pointing applications over a large angular FOV. The coarse positioning mechanism may include adjustment mechanisms for one or more axes that are used to adjust the pointing direction of the target.

20 Claims, 7 Drawing Sheets

USING A COARSE POSITIONING MECHANISM FOR PRECISION POINTING APPLICATIONS

GOVERNMENT LICENSE RIGHTS

This invention was made with Government support under (702SP-C) awarded by (Department of Defense—Air force). The government has certain rights in this invention.

BACKGROUND

Many host vehicles, such as satellites, planes, and ships may include one or more positioning mechanisms that are used to point a payload toward a target. For example, satellites may point an antenna toward a target, planes may point an imaging device toward a target, and the like. Different positioning mechanisms may be used for pointing a payload toward a target. For example, a satellite may include a two-axis gimbal system that is used to point an antenna toward a target. In some cases, a coarse positioning mechanism is used to fine tune the pointing of the antenna. For example, the azimuth angle and elevation angle of the coarse positioning mechanism may be changed a small amount (e.g., +−1 degree) to fine tune the pointing of the antenna. Adjusting a coarse positioning mechanism to cover a larger angular Field-Of-View (FOV), however, can result in unacceptable pointing errors.

SUMMARY

It should be appreciated that this Summary is provided to introduce a selection of concepts in a simplified form that are further described below in the Detailed Description. This Summary is not intended to be used to limit the scope of the claimed subject matter.

Apparatus, system and methods described herein are directed at compensating for pointing errors that may occur when using a coarse positioning mechanism for precision pointing applications. According to an aspect, a method is provided for using a coarse positioning mechanism for precision pointing of a payload. According to the method, target information is determined, which includes a location of a target. Positioning information is determined for use in adjusting the coarse positioning mechanism such that the payload points toward the target after the coarse positioning mechanism is adjusted. A position command is determined to adjust the coarse positioning mechanism. The position command is based on the positioning information and compensates for a nonlinear error and/or a cross-coupling error. The position command is then used to adjust the coarse positioning mechanism such that after the adjustment, the payload points toward the target.

According to another aspect, a system is provided that uses a coarse positioning mechanism for precision pointing. The system includes a platform that changes orientations to point a payload toward a target. A coarse positioning mechanism includes an azimuth adjustment mechanism that adjusts an azimuth angle of the platform and an elevation adjustment mechanism that adjusts an elevation angle of the platform. A controller is used for controlling adjustments to the azimuth adjustment mechanism and the elevation adjustment mechanism of the coarse positioning mechanism. A compensation component compensates for a nonlinearity error and/or a cross-coupling error that occur when the coarse positioning mechanism is adjusted.

According to yet another aspect, a coarse positioning apparatus is provided for precision pointing. The apparatus includes a platform that can change orientations to point a payload toward a target. A coarse positioning mechanism includes an azimuth adjustment mechanism that adjusts an azimuth angle of the platform and an elevation adjustment mechanism that adjusts an elevation angle of the platform. A controller controls the azimuth adjustment mechanism and the elevation adjustment mechanism. The controller may also determine a compensation for a nonlinearity error and/or a cross-coupling error that occurs when adjusting the orientation of the platform.

The features, functions, and advantages that have been discussed can be achieved independently in various embodiments of the present disclosure or may be combined in yet other embodiments, further details of which can be seen with reference to the following description and drawings.

DETAILED DESCRIPTION

Figure 1:
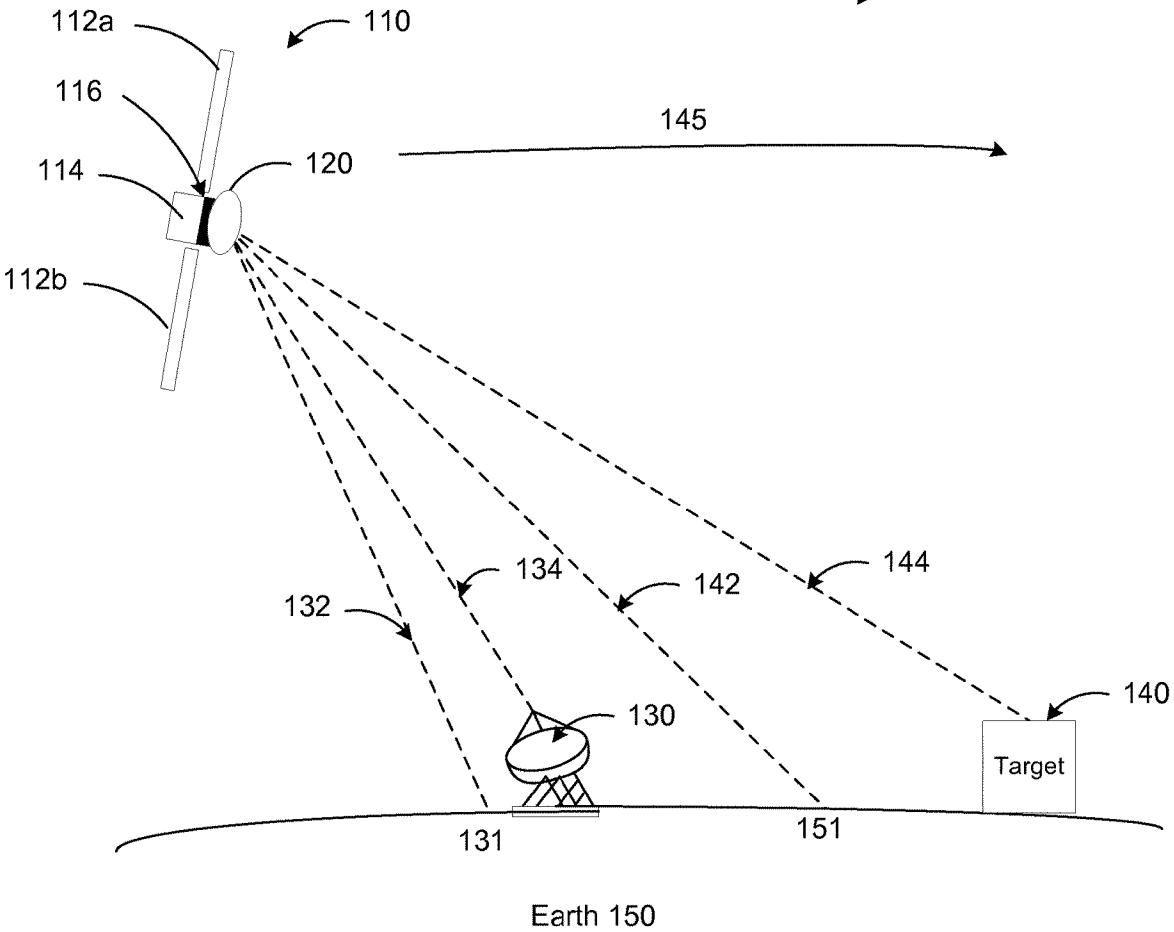
FIG. 1 shows an overview diagram of a satellite communication system that uses a coarse positioning mechanism for precision pointing applications.

The following detailed description is directed to compensating for nonlinear and cross-coupling errors when using a coarse positioning mechanism for precision pointing applications over a large angular FOV.

Typically, a coarse positioning mechanism is configured to make small adjustments (e.g., +−1 degrees) to change the pointing direction of a payload, such as a satellite antenna. For example, a satellite may include a two-axis gimbal system that is used for fine tuning an azimuth angle and an elevation angle of a satellite antenna. Using a coarse positioning mechanism to make these very small adjustments does not typically result in unacceptable pointing errors as the service LOS is typically very close to calibration LOS in these cases. Using a coarse positioning mechanism to precisely point a payload over a larger angular FOV and/or using the coarse positioning mechanism for dynamic precision tracking applications, however, may result in nonlinear and cross-coupling errors that are unacceptable for precision pointing applications.

Utilizing the concepts and technologies described herein, a coarse positioning mechanism may be used for precision pointing applications. Position commands to adjust the coarse positioning mechanism include compensation for errors (e.g., nonlinear and/or cross-coupling errors) that result when the coarse positioning mechanism is used for making these larger angular adjustments to the pointing direction of the payload. For example, instead of using a coarse positioning mechanism to adjust the pointing direction of a payload one half of a degree, the coarse positioning mechanism uses a compensation method to accurately adjust the pointing direction of the payload over a larger angular range (e.g., +−5 degrees, +−10 degrees, and the like).

The compensation method may be performed on-board the host vehicle (e.g., satellite, plane, ship) or at some other location (e.g., a ground control center). The compensation method may be performed initially when determining a command to adjust the coarse positioning mechanism to point the payload at the target or after initially adjusting the coarse positioning mechanism. For example, a single command may be sent to the coarse positioning mechanism that compensates for the errors or one or more commands may be sent to the coarse positioning mechanism to compensate for the nonlinear and/or cross-coupling errors after initially adjusting the coarse positioning mechanism.

In the following detailed description, references are made to the accompanying drawings that form a part hereof, and which are shown by way of illustration, specific embodiments, or examples. Referring now to the drawings, in which like numerals represent like elements through the several figures, a configurable tray table and method for employing the same according to the various embodiments will be described.

FIG. 1 shows an overview diagram of a satellite communication system that uses a coarse positioning mechanism for precision pointing applications.

As illustrated, communication system 100 shows satellite 110 that is orbiting the Earth 150 along orbital path 145. According to an embodiment, the orbital path is geostationary such that satellite 110 remains in a substantially fixed position relative to a point on the Earth 150. Other orbits, with which the satellite location changes drastically relative to the earth, may also be used.

Solar panel 112*a* and solar panel 112*b* are used to collect solar energy that may be converted to electrical energy. Satellite 110 includes antenna 120. Antenna 120 may include reflectors (not shown) that are used for reflecting and focusing electromagnetic signals transmitted to and received from Earth 150 and/or possibly other objects (e.g., other satellites, planes . . . ).

One or more ground-based transceivers, such as transceiver 130, may transmit signals to antenna 120 on satellite 110. Antenna 120 may be pointed to a ground-based transceiver, such as transceiver 130, such that transmitted uplink signals are received by satellite 110 and downlink signals are received by the transceiver.

Different types of information may be communicated using uplink and/or downlink transmissions. For example, the information may include telemetry data and control information that is used in: controlling the positioning of satellite 110; controlling the adjustments to coarse positioning mechanism 116; and the like. Generally, any type of information may be sent or received using uplink transmissions and/or downlink transmissions.

After launching a satellite, such as satellite 110, tests are often performed to determine how much to adjust the position of an antenna such that the antenna more accurately points to the desired target. For example, one or more In Orbit Tests (IOTs) may be performed to determine a series of measurements that are used to determine if any mechanical or RF parameters of antenna 120 have changed since being launched. The measurements may identify if antenna 120 is accurately pointed to the desired target, if there is any RF performance degradation, if there are any thermal deformations, and the like. The measurements may then be used to determine position commands that are used to adjust the coarse positioning mechanism 116 such that the antenna precisely points to the desired target. A compensation method is used by communication system 100 to compensate for errors introduced when adjusting coarse positioning mechanism 116 to precisely point antenna 120 toward a desired target.

FIG. 1 shows two different examples of using a coarse positioner for precisely pointing a payload, such as antenna 120, are shown. The first example illustrated shows using coarse positioning mechanism 116 to change the pointing direction of antenna 120 from location 131 to precisely point antenna 120 toward transceiver 130. Before fine-tuning the pointing direction of antenna 120, signal 132 from antenna 120 is slightly misaligned from transceiver 130. After fine-tuning the pointing direction of antenna 120 by adjusting the coarse positioning mechanism 116, antenna 120 points to target 130 as illustrated by signal 134. The first example illustrates a typical scenario for using a coarse positioning mechanism where the pointing direction of an antenna is changed a small amount (e.g., less than +−one degree). Generally, making these small adjustments to the pointing direction of antenna 120 using a coarse positioning mechanism does not result in unacceptable nonlinear errors or cross-coupling errors for pointing a payload.

It has been found, however, that when a coarse positioning mechanism, such as coarse positioning mechanism 116 (e.g., a two-axis gimbal system) is used for making adjustments that are larger than plus or minus one degree results in unacceptable errors when pointing a payload. For example, when a coarse positioning mechanism is instructed to change the azimuth angle eight degrees, it has been found that the azimuth nonlinear error may increase to about 0.1 degrees. The larger the instructed movement, the larger the error that is introduced. This error is unacceptable for precision pointing applications when there is no compensation for the errors.

Figure 3:
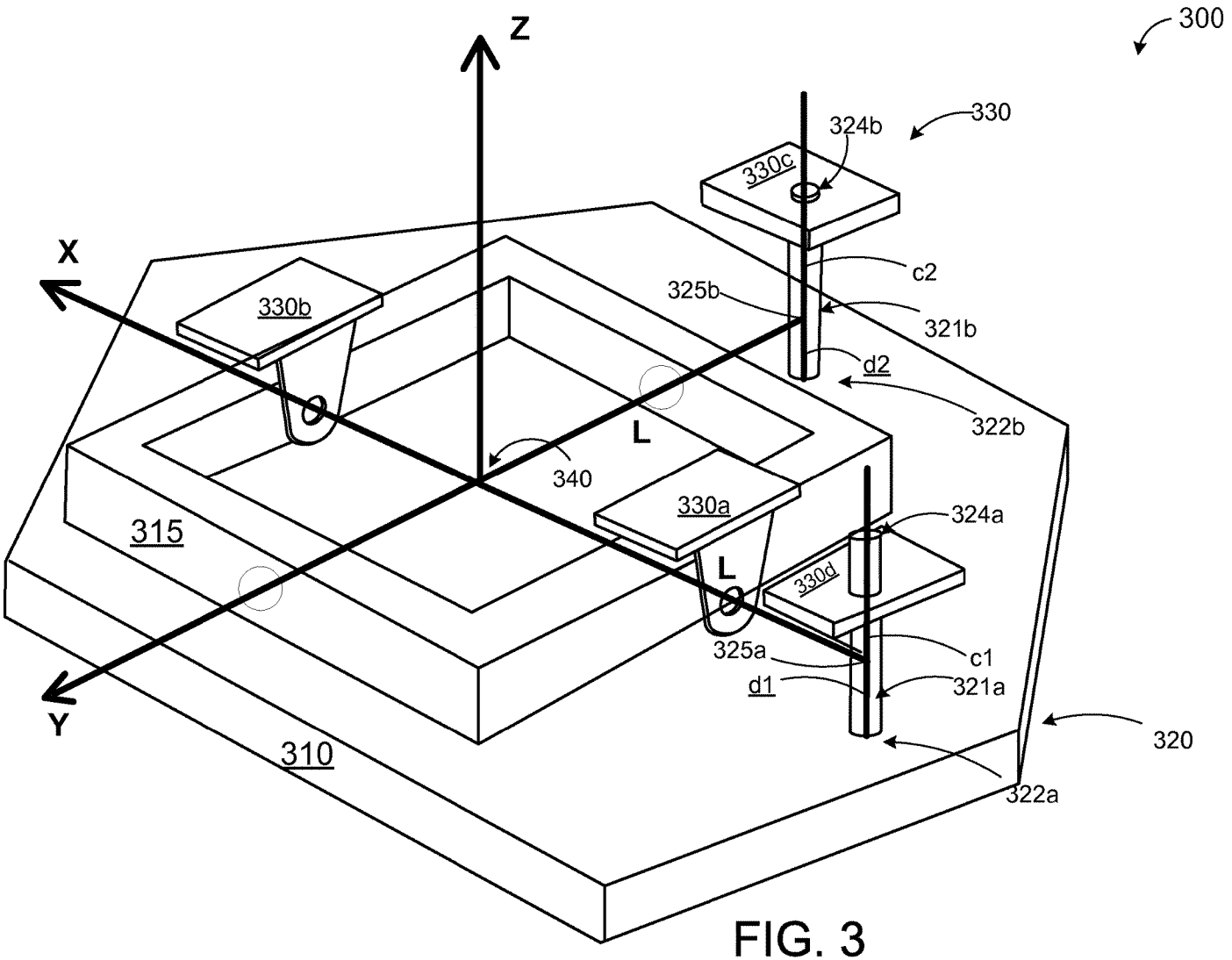
FIG. 3 illustrates an exemplary coarse positioning mechanism that includes azimuth and elevation adjustment mechanisms that may be used for precision pointing applications.

Using the compensation method described herein compensates for the errors such that coarse positioning mechanism 116 may be used for accurately pointing a payload over a large angular FOV. According to an embodiment, the compensation method is implemented as software that is performed either after an initial command to adjust the coarse positioning mechanism is performed or before initially adjusting the coarse positioning mechanism. The compensation method performs calculations that account for nonlinear and/or cross-coupling errors that may occur when coarse positioning mechanism 116 is adjusted over a large angular FOV. According to an embodiment, the coarse positioning mechanism is a coarse positioning mechanism such as illustrated in FIG. 3.

The second example that is shown in FIG. 1 illustrates using coarse positioning mechanism 116 to precisely point antenna 120 toward target 140. For example, coarse positioning mechanism 116 may be instructed to adjust the pointing direction of antenna 120 toward target 140. Initially, antenna 120 is pointed to location 151 as illustrated by signal 142. As briefly discussed, the compensation to account for nonlinear and/or cross-coupling errors may be performed before initially pointing the payload toward the target or after initially pointing the payload to the target. According to an embodiment, the compensation method calculates an amount to move one or more adjustment mechanisms (e.g., an azimuth adjustment mechanism and an elevation adjustment mechanism) using one or more equations that are determined using characteristics of the coarse positioning mechanism.

After performing the compensation method that compensates for the nonlinear errors and/or cross-coupling errors, one or more position commands are performed by coarse positioning mechanism 116 to precisely point antenna 120 to target 140 as illustrated by signal 144. More details regarding compensating for nonlinear errors and cross-coupling errors are described below.

Figure 2:
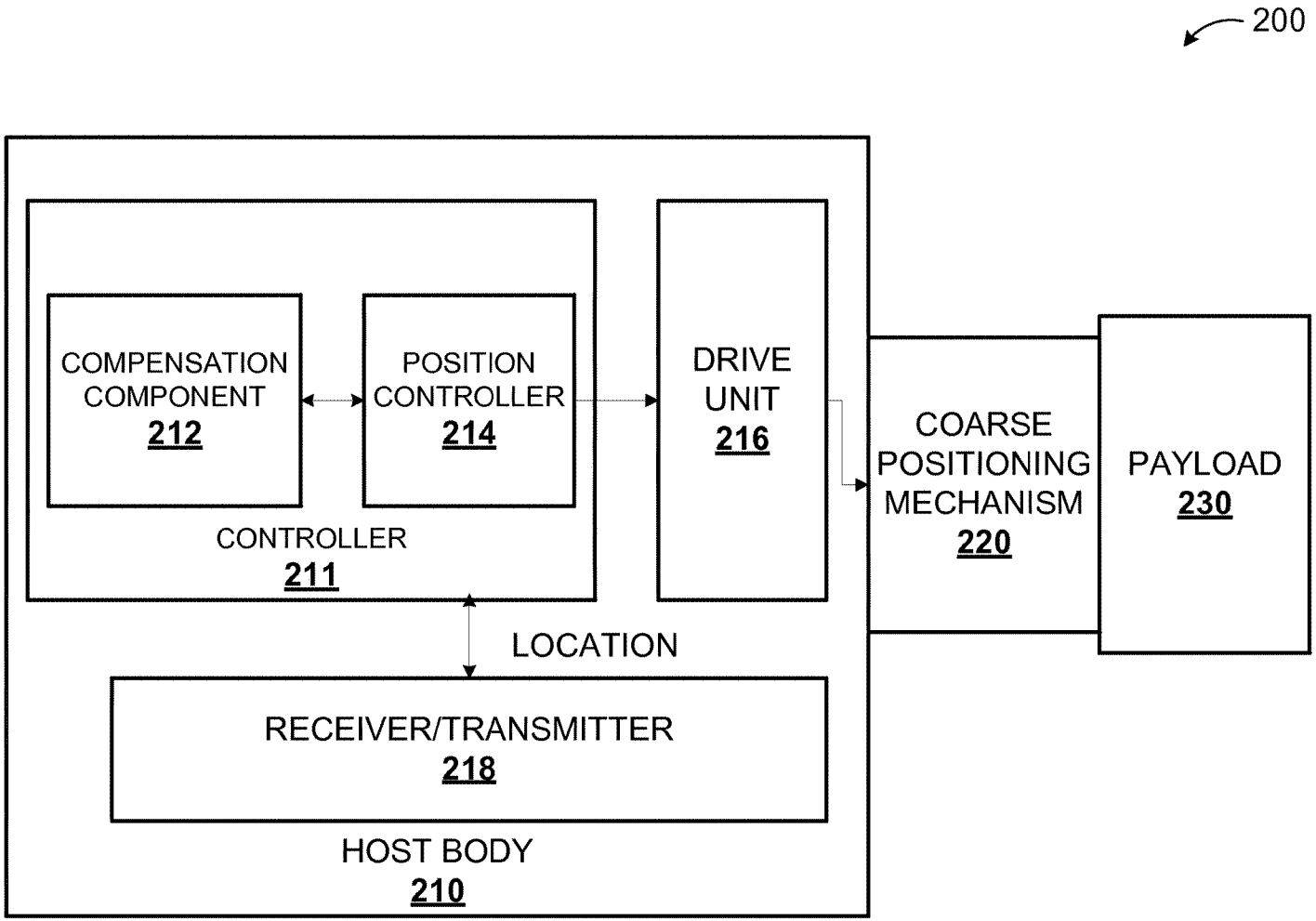
FIG. 2 shows a schematic of a host vehicle that includes a coarse positioning mechanism that may be used for precision pointing applications.

FIG. 2 shows a schematic of a host vehicle that includes a coarse positioning mechanism that may be used for precision pointing applications. Host vehicle 200 may be a variety of different vehicles, such as, but not limited to: a satellite, a plane, a ship, and the like. According to an embodiment, host vehicle 200 is a satellite, such as satellite 110 as shown in the communication system 100 of FIG. 1.

Host vehicle 200 includes a host body 210 and payload 230 that is positioned using coarse positioning mechanism 220. Payload 230 may be any type of payload that is pointed toward a target, such as, but not limited to an antenna, a reflector, a laser, a camera, a sensor, and the like. Generally, payload 230 is any payload that may be used in precision pointing applications.

Payload 230 (e.g., an antenna) is coupled to coarse positioning mechanism 220 for pointing or directing the payload in different directions to one or more targets. Payload 230 may be coupled to a platform (not shown) on coarse positioning mechanism 220 are coupled using some other method. According to an embodiment, coarse positioning mechanism 220 is used for performing precision tracking over a large angular FOV (e.g., over 4 degrees adjustment).

Payload 230 is positioned relative to the host body 210 using coarse positioning mechanism 220. According to an embodiment, coarse positioning mechanism 220 includes an azimuth adjustment mechanism and an elevation adjustment mechanism. For example, coarse positioning mechanism 220 may include a two-axis gimbal that is configured to provide adjustment of payload 230 in at least two axes. The coarse positioning mechanism may include the two linear drivers (jackscrews) that produces rotational (gimbaling) motion of the payload by increasing or decreasing the displacements of the jackscrews. Other coarse positioning mechanisms may be used.

Pointing payload 230 toward a target using coarse positioning mechanism 220 without compensating for nonlinear and/or cross-coupling errors may result in pointing inaccuracies that are unacceptable for precision pointing applications. In precision pointing and tracking applications, high-precision pointing control is desired such that that payload 230 (e.g., an antenna, laser, camera . . . ) can continuously track a target. Instead of using an expensive positioning mechanism for precision pointing applications, coarse positioning mechanism 220 includes compensation component 212 that is used to compensate for nonlinear and/or cross-coupling errors. Receiver/transmitter 218 may be used to receive/send commands and other information from host vehicle 200 to a remote location.

As shown, controller 211 receives a location (LOCATION) of a target that indicates where to point payload 230. The location may be determined from on-board processing and/or from a remote location (e.g., a ground control station).

Controller 211 includes compensation component 212 and position controller 214. Controller 211 is configured to determine position commands that include compensation for nonlinear and/or cross-coupling errors using compensation component 212 and/or position controller 214. All or a portion of controller 211 may be located onboard host vehicle 200 or be located remotely from host vehicle 200. For example, all of or a portion of position controller 214 and/or compensation component 212 may be located at a ground station (not shown). Controller 211 includes one or more processors and memory. The one or more processors may execute computer instructions stored in the memory to implement and execute the various functions of controller 211. For example, the functions may include determining positioning commands to adjust coarse positioning mechanism 220 that compensates for nonlinear and cross-coupling errors.

Controller 211 determines one or more position commands that may be used to adjust coarse positioning mechanism 220 to point payload 230 toward the desired target. Position controller 214 is configured to communicate with compensation component 212 to determine how to compensate for nonlinear and/or cross-coupling errors that may occur when adjusting coarse positioning mechanism 220 over a large angular FOV.

Compensation component 212 may determine zero or more position commands that may be used to move coarse positioning mechanism 220 to point payload 230 to the desired target. Compensation component 212 is configured to calculate compensation information based on the coarse positioning mechanism being used to point the payload toward the target. According to an embodiment, compensation component 212 calculates an amount to move an azimuth adjustment mechanism and an elevation adjustment mechanism (e.g., moving one or more jackscrews) based on equations that are derived from and are based on the characteristics of the coarse positioning mechanism (See FIG. 3 and related discussion).

After determining the position commands that are used to adjust the pointing direction of the payload, controller 211 communicates the position commands to drive unit 216. Drive unit 216 is configured to provide control signals to coarse positioning mechanism 220 to adjust the pointing direction of payload 230 such that payload 230 is precisely pointed at the target.

FIG. 3 illustrates an exemplary coarse positioning mechanism that includes azimuth and elevation adjustment mechanisms that may be used for precision pointing applications. As illustrated, coarse positioning mechanism 300 includes base 310, platform 315, azimuth adjustment mechanism 320 and elevation adjustment mechanism 330.

Coarse positioning mechanism 300 is configured to adjust a pointing direction of a payload (not shown) along two axes (the x and y axes). As illustrated, coarse positioning mechanism 300 is configured for adjusting an azimuth angle (rotation about the y axis) and an elevation angle (rotation about the x axis) for a coupled payload (not shown). As discussed above, different payloads may be coupled to coarse positioning mechanism 300 (e.g., an antenna, laser, camera, or some other type of sensor or device). In the current example, a payload may be coupled to coarse positioning mechanism 300 at locations 330*a*, 330*b*, 330*c*, and 330*d*. A payload may be coupled to coarse positioning mechanism 300 using other methods.

Both the azimuth angle and the elevation angle of a coupled payload may be adjusted relative to a host vehicle by adjusting azimuth adjustment mechanism 320 and elevation adjustment mechanism 330. In the current example, azimuth adjustment mechanism 320 and elevation adjustment mechanism 330 are adjusted by changing a length of the associated shaft (azimuth shaft 321*a* and elevation shaft 321*b*). Changing the length (d1) of azimuth shaft 321*a* changes the azimuth angle of a payload that is coupled to coarse positioning mechanism 300. Changing the length (d2) of elevation shaft 321*b* changes the elevation angle of a payload that is coupled to coarse positioning mechanism 300.

Equations are used to determine an amount to adjust the length of azimuth shaft 321*a* and an amount to adjust elevation shaft 321*b* in order to precisely point a payload toward the target. The equations compensate for nonlinear and/or cross-coupling errors that are associated with the particular coarse positioning mechanism being used, such as coarse positioning mechanism 300.

In the current example, the following equation that is directed at compensating for nonlinear and cross-coupling errors is used to determine how much to change the length of the elevation shaft 321*b* that controls the adjustment of the elevation angle of coarse positioning mechanism 300:

$$\Delta h_e=\sqrt{2L^2+c2^2+d2^2-2L^2\cos e+2Lc2\sin e+2Ld1\cos a\sin e+2c2d2\cos a\cos e}-(d2+c2)$$

where: a is the desired azimuth angle; e is the desired elevation angle; L is the distance from center location 340 to the center of elevation shaft 321*b*; c2 is the distance from the top center 324*b* to axis location 325*b*, and d2 is the distance from bottom center 322*b* to axis location 325*b*.

The following equation that is directed at compensating for nonlinear and cross-coupling errors is used to determine how much to change the length of the azimuth shaft 321*a* that controls the adjustment of the azimuth angle of coarse positioning mechanism 300:

$$\Delta h_a=\sqrt{(L-L\cos a+c1\sin a)+(d1+L\sin a+c1\cos a)}-(d1+c1)$$

where: a is the desired azimuth angle; L is the distance from center location 340 to the center of elevation shaft 321*a*; c1 is the distance from the top center 324*a* to axis location 325*a*, and d1 is the distance from the bottom center 322*a* to axis location 325*a*.

After determining an amount to move azimuth shaft 321*a* and elevation shaft 321*b*, the shafts may be instructed to be moved by a controller (not shown) such that a coupled payload is precisely pointed to the desired target. The above equations are for illustrative purposes and are not intended to be limiting. For example, similar equations that compensate for nonlinear and/or cross-coupling errors for other coarse positioning mechanisms may be determined based on the physical and operational characteristics of the coarse positioning mechanism. While coarse positioning mechanism 300 is shown to include adjustments for two axes (an azimuth axis and an elevation axis), more or fewer axes may be included in a coarse positioning mechanism (e.g. one axis or three axes).

Figure 4:
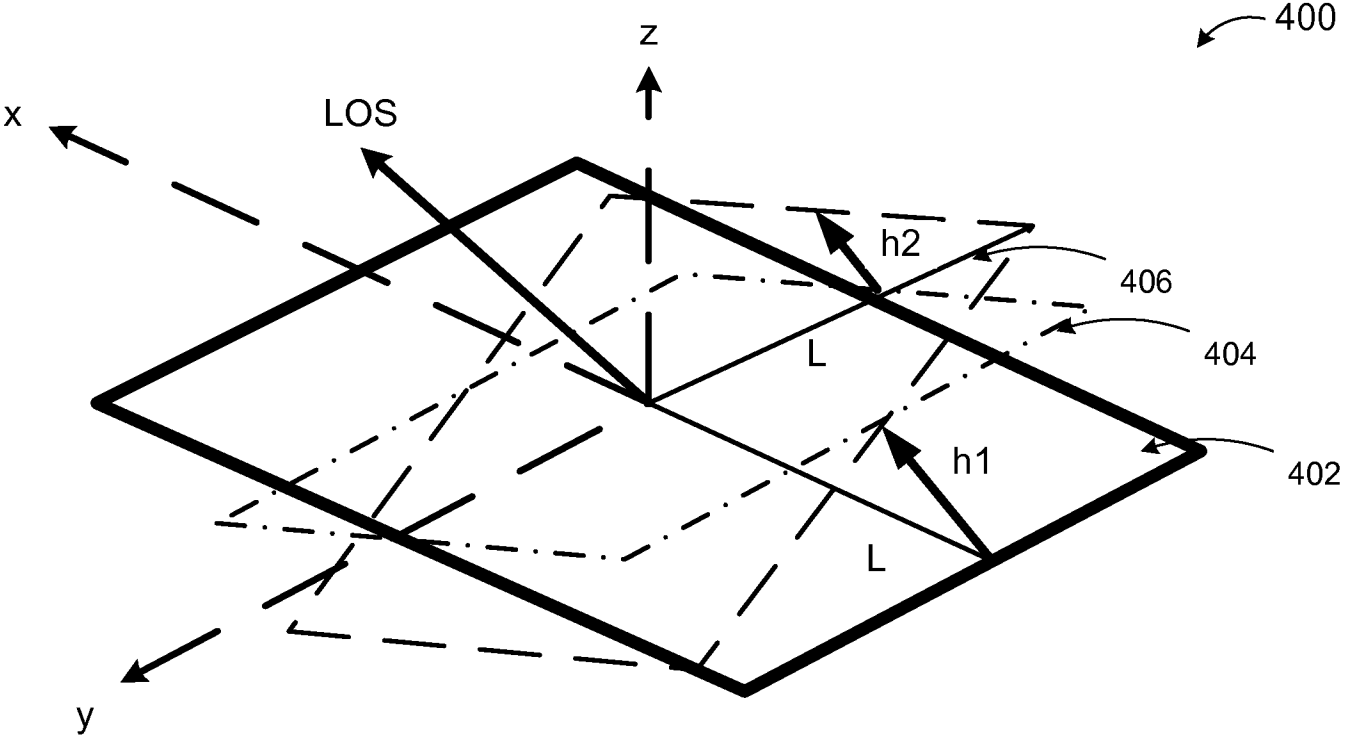
FIG. 4 shows a diagram that illustrates the relationship between adjusting an azimuth angle and elevation angle to adjust the pointing direction of a payload.

FIG. 4 shows a diagram that illustrates the relationship between adjusting an azimuth angle and elevation angle to adjust the pointing direction of a payload. As illustrated, a platform orientation is moved from orientation 402 to desired orientation 406 such that a payload (not shown) is pointing toward the determined target down along the LOS vector. As discussed herein, an azimuth angle and an elevation angle that are adjusted to point a payload toward a target are determined based on a LOS for the target. According to an embodiment, a determination is made as to how much adjust a length of an azimuth shaft (h1) and how much to adjust the length of an elevation shaft (h2) (See FIG. 3 and related discussion).

Orientation 402 shows a current orientation of a platform (not shown) that is attached to a coarse positioning mechanism and orientation 406 shows the desired orientation of the platform after adjusting the coarse positioning mechanism such that the payload that is coupled to the platform precisely points to the desired target. A platform of a coarse positioning mechanism may be moved using independent movements. For example, either the elevation angle or the azimuth angle may be adjusted before adjusting the other angle. The elevation angle and the azimuth angle may also be changed concurrently, such that the platform appears to more smoothly move to the desired azimuth angle and elevation angle. After determining the adjustments to the length of the elevation shaft and the azimuth shaft using the equations that account for nonlinearity and cross-coupling errors, the platform that is coupled to the coarse positioning mechanism is adjusted from orientation 402 to orientation 406.

Figure 5:
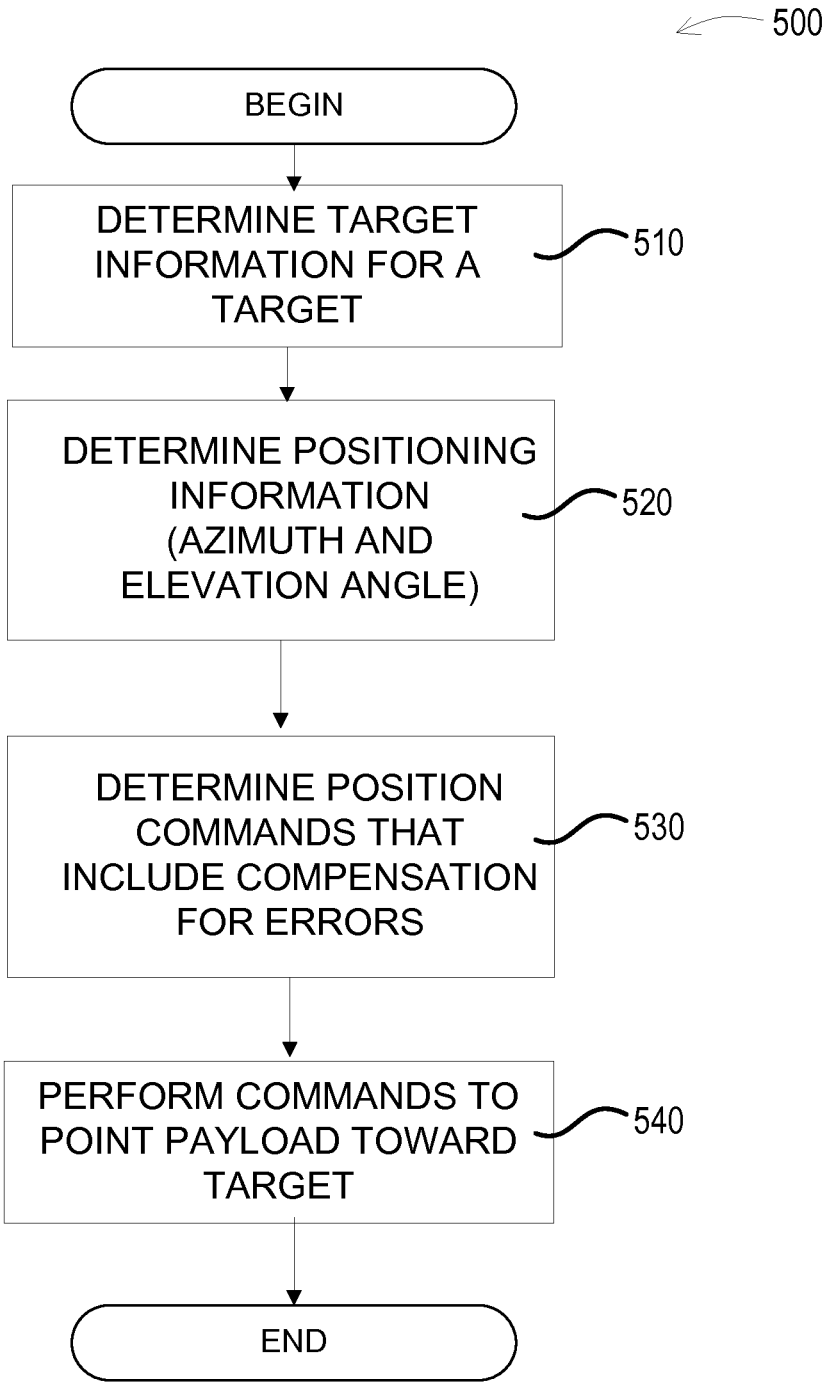
FIG. 5 illustrates a routine that includes compensation for errors when using a coarse positioning mechanism for precision pointing applications.
Figure 6:
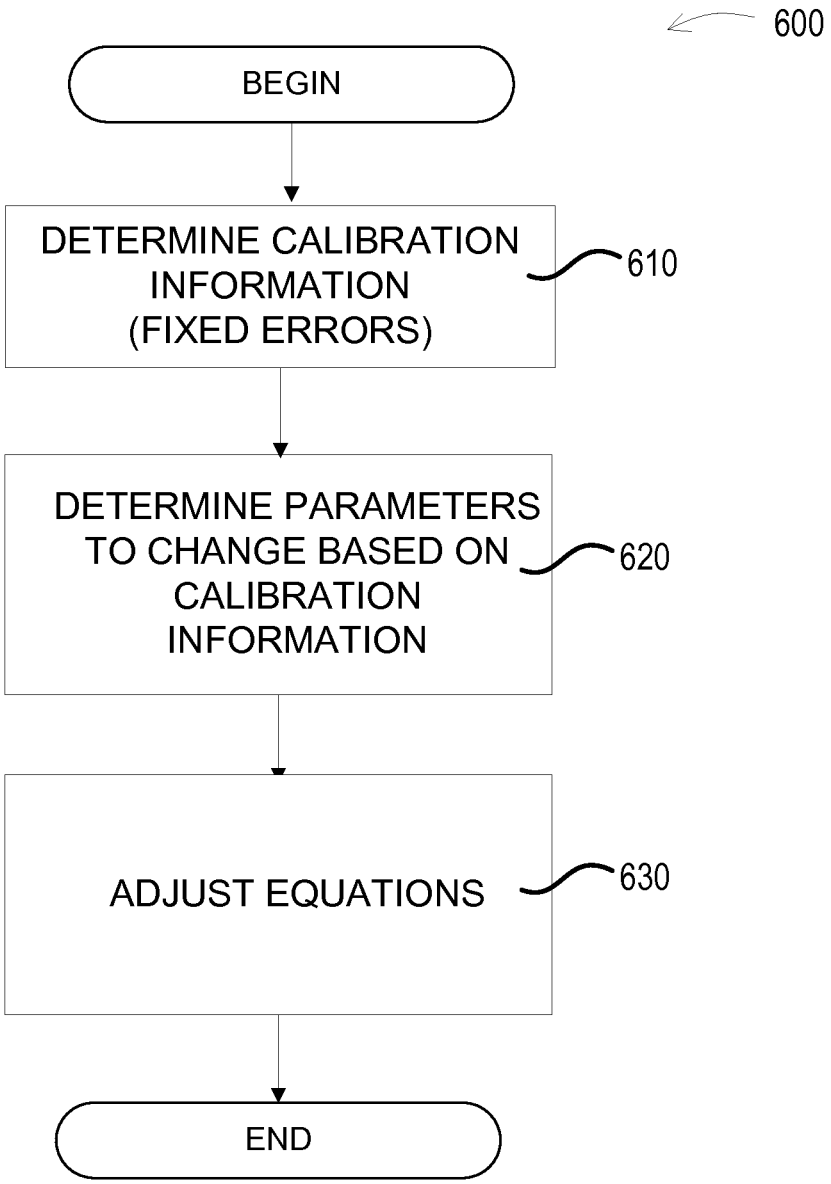
FIG. 6 shows an illustrative process for calibrating a coarse positioning mechanism.

Turning now to FIGS. 5 and 6, illustrative routines are described for using a coarse positioning mechanism for precision pointing applications. It should be appreciated that more or fewer operations may be performed than shown in the figures and described herein. These operations may also be performed in a different order than those described herein.

FIG. 5 illustrates a routine that includes compensation for errors when using a coarse positioning mechanism for precision pointing applications. Routine 500 begins at operation 510, where target information for a target is determined. The targets may be different types of targets. For example, the target may be an object (stationary or moving) or a location (e.g., on Earth, in space . . . ). The target information may include different types of information. For example, the target information may include the longitude and latitude of the target. The target information may also include other types of information, such as whether the target is configured to transmit information to the host vehicle, whether the target includes a beacon device, and the like. The target information may be received from a remote location and/or determined on a host vehicle.

From operation 510, routine 500 continues to operation 520, where positioning information is determined for the target. Generally, the positioning information is used to determine how to precisely point the payload (e.g., an antenna, a sensor . . . ) toward the target. According to an embodiment, a line-of-sight from the host vehicle to the target is determined. The line-of-sight may be used to determine how much to change the orientation of a platform such that the coupled payload precisely points to the target after the coarse positioning mechanism is adjusted. According to an embodiment, an azimuth angle and an elevation angle are determined. The azimuth angle and the elevation angle indicate a desired orientation of the payload.

Transitioning to operation 530, one or more position commands for adjusting the coarse positioning mechanism that include compensation for errors are determined. According to an embodiment, the compensation for errors includes compensating for nonlinear and cross-coupling errors that may occur when pointing a payload at the determined target using the coarse positioning mechanism. As discussed above, the equations that are used to determine position commands that instruct how to adjust a coarse positioning mechanism and compensate for the errors are determined based on the type of coarse positioning mechanism being used. For example, the equations will change based on the type of coarse positioning mechanism and the number of axes that are adjusted by the coarse positioning mechanism (See FIG. 3 and related discussion for exemplary equations). According to an embodiment, the position commands instruct the coarse positioning mechanism to adjust one or more jackscrews that when adjusted change an azimuth angle and/or an elevation angle to point the payload at the target.

Flowing to operation 540, the position commands are performed by the coarse positioning mechanism. The positioning commands may be processed and performed sequentially or concurrently. For example, one or more position commands may first be performed to adjust an azimuth angle axis being adjusted followed by performing one or more commands to adjust an elevation angle. Alternatively, the position commands may be performed concurrently. Routine 500 then flows to an end operation and returns to processing other actions.

FIG. 6 shows an illustrative process for calibrating a coarse positioning mechanism. Routine 600 begins at operation 610, where calibration information is determined. The calibration information may include various types of information. The calibration information relates to fixed errors relating to the coarse positioning mechanism. For example, assume the length of a component in the coarse positioning mechanism was machined to be 12 inches, but when deployed is measured to be 12.05 inches. Another component may be specified to be at a 90 degree angle to another component, but is determined to be at 90.1 degrees after the coarse positioning mechanism is deployed. More or less fixed errors may be identified.

The discrepancies may be caused by various reasons. For example, the parts may be machined to a different tolerance level and/or conditions where the coarse positioning mechanism is deployed (e.g., space) may cause the discrepancies. Different methods of determining the calibration information may be used. For example, inspection of the components may be determined after deploying the coarse positioning mechanism (e.g., using a camera and/or some other sensing device).

Moving to operation 620, the calibration information is used to determine what parameters to change in the equations described above (See FIG. 3 and related discussion). For example, if the length (L) was initially set to be twelve inches in the equations but the calibration information indicates that the observed length L is actually 12.1 inches, then the parameter L is indicated to be changed.

Flowing to operation 630, the equations that are used to determine the position commands are adjusted based on the calibration information and information determined in operations 610 and 620. For example, the parameter L is changed in the equations from 12 inches to the observed length of 12.1 inches. Routine 600 then flows to an end operation and returns to processing other actions.

Figure 7:
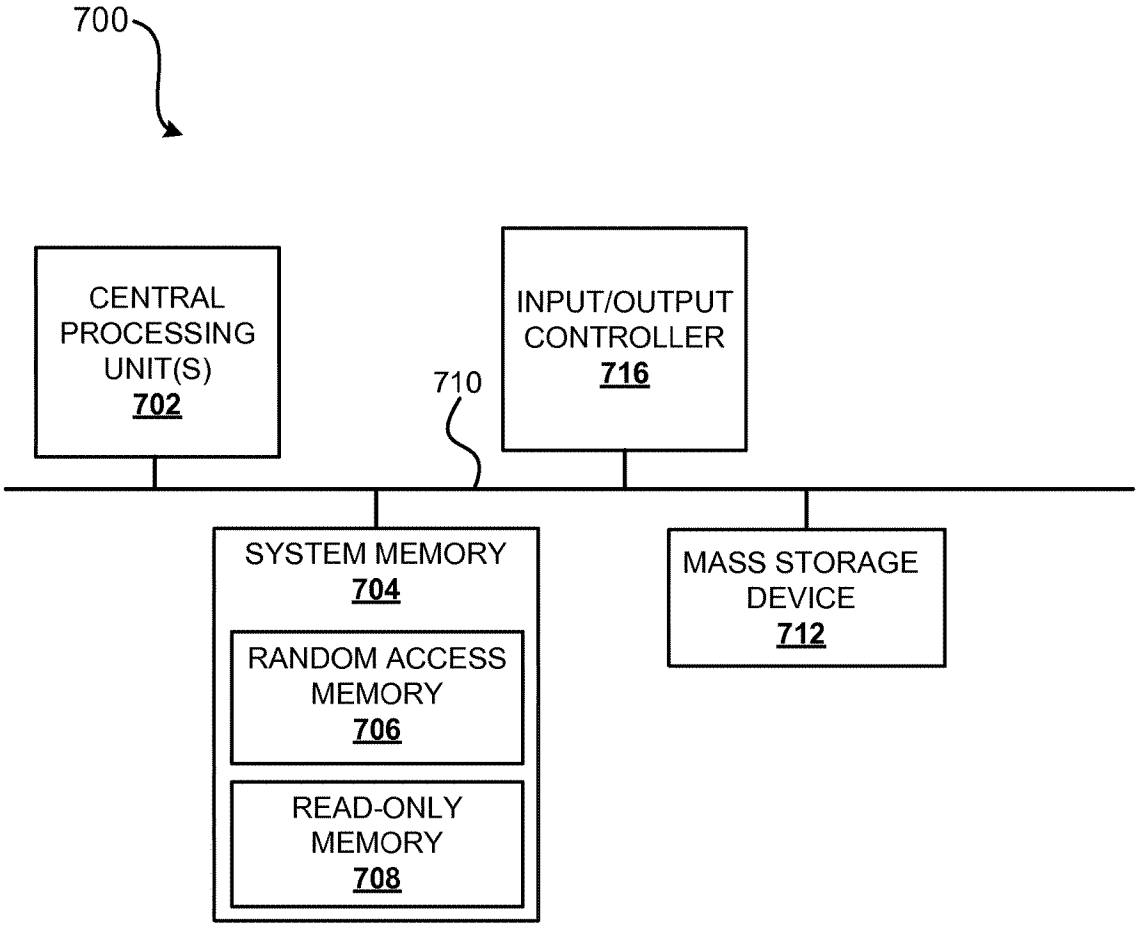
FIG. 7 illustrates a computer in which a coarse position mechanism that compensates for errors according to various embodiments presented herein.

FIG. 7 illustrates a computer in which a coarse position mechanism that compensates for errors may be operated according to at least one embodiment disclosed herein. The computer 700 illustrated in FIG. 7 includes one or more central processing unit(s) ("CPUs") 702, a system memory 704, including a random-access memory ("RAM") 706 and a read-only memory ("ROM") 708, and a system bus 710 that couples the system memory 704 to the CPU 702. A basic input/output system containing the routines that help to transfer information between elements within the computer 700, such as during startup, may be stored in the ROM 708.

The CPUs 702 may be standard programmable processors that perform arithmetic and logical operations for the operation of the computer 700, such as the routines 500 and 600 described above. The CPUs 702 may perform the operations by transitioning from one discrete, physical state to the next through the manipulation of switching elements that differentiate between and change these states. Switching elements may generally include electronic circuits that maintain one of two binary states, such as flip-flops, and electronic circuits that provide an output state based on the logical combination of the states of one or more other switching elements, such as logic gates. These basic switching elements may be combined to create more complex logic circuits, including registers, adders-subtractors, arithmetic logic units, floating-point units, and the like.

The computer 700 may also include a mass storage device 712. The mass storage device may be an optical disk, a magnetic storage device, or a solid state storage device. The mass storage device 712 may be operative to store one or more instructions to control a fuel cell discharge controller. In another configuration, the RAM 706, ROM 708, and the mass storage device 712 may be operative to have stored thereon, either alone or in various combinations, instructions for controlling a fuel cell discharge controller.

The computer 700 may store programs and data on the mass storage device 712 by transforming the physical state of the mass storage device 712 to reflect the information being stored. The specific transformation of physical state may depend on various factors, in different implementations of this disclosure. Examples of such factors may include, but are not limited to, the technology used to implement the mass storage device 712, whether the mass storage device 712 is characterized as primary or secondary storage, and the like.

For example, the computer 700 may store information to the mass storage device 712 by issuing instructions through a storage controller to alter the magnetic characteristics of a particular location within a magnetic disk drive device, the reflective or refractive characteristics of a particular location in an optical storage device, or the electrical characteristics of a particular capacitor, transistor, or other discrete component in a solid-state storage device. Other transformations of physical media are possible without departing from the scope and spirit of the present description, with the foregoing examples provided only to facilitate this description. The computer 700 may further read information from the mass storage device 712 by detecting the physical states or characteristics of one or more particular locations within the mass storage device 712.

The RAM 706, the ROM 708, or the mass storage device 712 may be operative as computer-readable storage mediums. Various aspects of the present disclosure may be stored on other types of computer-readable storage mediums, such as, but not limit to, RAM, ROM, EPROM, EEPROM, flash memory or other solid state memory technology, CD-ROM, digital versatile disks ("DVD"), HD-DVD, BLU-RAY, or other optical storage, magnetic cassettes, magnetic tape, magnetic disk storage or other magnetic storage devices, or any other medium that can be used to store the desired information and which can be accessed by the computer 700. It should be understood that when the claims are interpreted in light of this present disclosure, a computer-readable storage medium does not include energy in the form of waves or signals.

The computer 700 also may include an input/output controller 716 for receiving and processing input from a number of other devices, including a keyboard, mouse, or electronic stylus. Similarly, the input/output controller 716 may provide an output to a display screen, a printer, or other type of output device. One or more embodiments may include a computer-readable storage medium manufactured so that, when read by a properly configured computing device, instructions may be provided to perform operations for compensating for nonlinear and/or cross-coupling errors when using a coarse positioning mechanism for precision pointing.

The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A method for using a coarse positioning mechanism for precision pointing of a payload toward a target, the method comprising:

determining, using a controller comprising one or more computer processors, target information that includes a location of the target;

determining, via a position controller of the controller, positioning information that is used in determining how to adjust the coarse positioning mechanism such that the payload points toward the target after the coarse positioning mechanism is adjusted;

determining, using a compensation component of the controller, a position command to adjust the coarse positioning mechanism that is based on the positioning information and compensates for at least one of a nonlinear error or a cross-coupling error, wherein determining a position command to adjust the coarse positioning mechanism comprises:

calculating an adjustment to a length of a shaft of the coarse positioning mechanism, wherein calculating an adjustment to a length of a shaft is based on (1) a desired azimuth angle, (2) a first distance from a center location of the coarse positioning mechanism to a center of the shaft, (3) a second distance from a top center of the shaft to an axis location, and (4) a third distance from a bottom center of the shaft to the axis location; and applying the position command to a drive unit coupled with the controller to adjust the coarse positioning mechanism such that after the coarse positioning mechanism is adjusted, the payload points toward the target.

2. The method of claim 1, wherein determining the positioning information comprises determining a line-of-sight from the coarse positioning mechanism to the location of the target.

3. The method of claim 1, wherein determining the positioning information comprises determining the desired azimuth angle and determining an elevation angle to move a platform that is coupled to the coarse positioning mechanism.

4. The method of claim 1, wherein determining the position command to adjust the coarse positioning mechanism comprises determining an amount to move an azimuth adjustment mechanism.

5. The method of claim 1, wherein determining the position command to adjust the coarse positioning mechanism comprises determining an amount to move an elevation adjustment mechanism.

6. The method of claim 1, wherein determining the position command to adjust the coarse positioning mechanism comprises compensating for the nonlinear error and for the cross-coupling error.

7. The method of claim 1, further comprising:

performing a calibration that changes at least one parameter in an equation that is used in determining the position command that relates to a determined fixed error of the coarse positioning mechanism.

8. The method of claim 1, wherein calculating an adjustment to a length of a shaft of the coarse positioning mechanism is performed using an equation that is substantially similar to:

$$\Delta h_a = \sqrt{(L-L\cos a+c2\sin a)+(d2+L\sin a+c2\cos a)^2}-(d2+c2),$$

where: a is the desired azimuth angle; L is the first distance from a center location of the coarse positioning mechanism to a center of the shaft; c2 is the second distance from a top center of the shaft to an axis location; and d2 is the third distance from a bottom center of the shaft to the axis location.

9. The method of claim 1, wherein calculating an adjustment to a length of a shaft of the coarse positioning mechanism is performed using an equation that is substantially similar to:

$$\Delta h_e = \sqrt{2L^2+c1^2+d1^2-2L^2\cos e+2Lc1\sin e+2Ld1\cos a\sin e+2c1d1\cos a\cos e-(d1+c1)},$$

where: a is the desired azimuth angle; e is a desired elevation angle; L is the first distance from a center location of the coarse positioning mechanism to a center of the shaft; c1 is the second distance from a top center of an shaft to an axis location; and d1 is the third distance from a bottom center of the shaft to the axis location.

10. A system using a coarse positioning mechanism for precision pointing, the system comprising:

a platform that is configured to change orientations to point a payload toward a target;

a coarse positioning mechanism that is coupled to the platform and that includes an azimuth adjustment mechanism configured to adjust an azimuth angle of the platform and an elevation adjustment mechanism configured to adjust an elevation angle of the platform;

a controller that is coupled to the coarse positioning mechanism and that is configured for controlling, via determined position commands, adjustments to the azimuth adjustment mechanism and the elevation adjustment mechanism of the coarse positioning mechanism, wherein determining a position command to adjust the coarse positioning mechanism comprises:

calculating an adjustment to a length of a shaft of the coarse positioning mechanism, wherein calculating an adjustment to a length of a shaft is based on (1) a desired azimuth angle, (2) a first distance from a center location of the coarse positioning mechanism to a center of the shaft, (3) a second distance from a top center of the shaft to an axis location, and (4) a third distance from a bottom center of the shaft to the axis location; and a compensation component that is configured to compensate for at least one of a nonlinearity error or a cross-coupling error that occurs when the coarse positioning mechanism is adjusted.

11. The system of claim 10, wherein the controller is configured to receive positioning information for the target that comprises the desired azimuth angle and a desired elevation angle.

12. The system of claim 10, wherein determining a position command to adjust the coarse positioning mechanism is based on positioning information that is associated with the target.

13. The system of claim 12, wherein determining the position command to adjust the coarse positioning mechanism that is based on the positioning information comprises determining an amount to adjust the azimuth adjustment mechanism and determining an amount to adjust the elevation adjustment mechanism.

14. The system of claim 10, wherein the compensation component is configured to compensate for the nonlinear error and for the cross-coupling error.

15. The system of claim 10, wherein the controller is further configured to perform a calibration that changes at least one parameter in an equation that is used in determining a position command to adjust the coarse positioning mechanism that relates to a determined fixed error of the coarse positioning mechanism.

16. A coarse positioning apparatus for precision pointing, the coarse positioning apparatus comprising:

a platform that is configured to change orientations to point a coupled payload toward a target;

a coarse positioning mechanism that is coupled to the platform and that includes an azimuth adjustment mechanism configured to adjust an azimuth angle of the platform and an elevation adjustment mechanism configured to adjust an elevation angle of the platform; and a controller that is coupled to the coarse positioning mechanism, the controller configured to:

control, via determined position commands, the azimuth adjustment mechanism and the elevation adjustment mechanism, wherein determining a position command to adjust the coarse positioning mechanism comprises:

calculating an adjustment to a length of a shaft of the coarse positioning mechanism, wherein calculating an adjustment to a length of a shaft is based on (1) a desired azimuth angle, (2) a first distance from a center location of the coarse positioning mechanism to a center of the shaft, (3) a second distance from a top center of the shaft to an axis location, and (4) a third distance from a bottom center of the shaft to the axis location; and determine a compensation for at least one of a nonlinearity error or a cross-coupling error that occurs when adjusting the orientation of the platform.

17. The coarse positioning apparatus of claim 16, wherein the controller is further configured to:

determine positioning information for the target that comprises the desired azimuth angle and a desired elevation angle of the platform.

18. The coarse positioning apparatus of claim 16, wherein determining a position command to adjust the coarse positioning mechanism compensates for the at least one of the nonlinear error or the cross-coupling error.

19. The coarse positioning apparatus of claim 18, wherein determining the position command to adjust the coarse positioning mechanism comprises determining an amount to adjust the azimuth adjustment mechanism and determining an amount to adjust the elevation adjustment mechanism.

20. The coarse positioning apparatus of claim 16, wherein the controller determines a compensation for the nonlinear error and for the cross-coupling error.

* * * * *